US009080369B2

(12) United States Patent
Rakhmanin

(10) Patent No.: US 9,080,369 B2
(45) Date of Patent: Jul. 14, 2015

(54) FLOOD PROTECTION BARRIER SYSTEM AND METHOD

(71) Applicant: Vladimir Rakhmanin, Rockville, MD (US)

(72) Inventor: Vladimir Rakhmanin, Rockville, MD (US)

( * ) Notice: Subject to any disclaimer, the term of this patent is extended or adjusted under 35 U.S.C. 154(b) by 0 days.

(21) Appl. No.: 14/052,573

(22) Filed: Oct. 11, 2013

(65) Prior Publication Data

US 2014/0109482 A1 Apr. 24, 2014

Related U.S. Application Data

(60) Provisional application No. 61/795,733, filed on Oct. 24, 2012.

(51) Int. Cl.

| | |
|---|---|
| ***E06B 9/00*** | (2006.01) |
| ***E02B 7/00*** | (2006.01) |
| ***E02B 7/02*** | (2006.01) |
| ***E06B 9/06*** | (2006.01) |

(52) U.S. Cl.

CPC ... *E06B 9/00* (2013.01); *E02B 7/00* (2013.01); *E02B 7/02* (2013.01); *E06B 9/0692* (2013.01); *E06B 2009/007* (2013.01)

(58) Field of Classification Search

CPC ... E06B 9/00; E06B 9/0692; E06B 2009/007; E02B 7/00; E02B 7/02; E02B 7/08; E02B 7/20

USPC ..... 49/21, 62, 61, 463–466, 10, 12; 405/114, 110, 115, 107, 109, 112; 52/202, 203, DIG. 12; 404/6, 9

See application file for complete search history.

(56) References Cited

U.S. PATENT DOCUMENTS

| | | | | |
|---|---|---|---|---|
| 4,136,995 | A * | 1/1979 | Fish | 405/115 |
| 4,692,060 | A * | 9/1987 | Jackson, III | 405/115 |
| 5,470,177 | A * | 11/1995 | Hughes | 405/115 |
| 5,605,416 | A * | 2/1997 | Roach | 405/21 |
| 5,645,373 | A * | 7/1997 | Jenkins | 405/91 |
| 5,829,915 | A * | 11/1998 | Andreassen | 405/18 |
| 6,413,014 | B1 * | 7/2002 | Melin | 405/107 |
| 7,445,403 | B2 * | 11/2008 | Williams et al. | 405/107 |
| 8,245,891 | B2 * | 8/2012 | Eriksen | 222/481.5 |
| 2004/0096275 | A1 * | 5/2004 | Rorheim | 405/107 |
| 2006/0016051 | A1 * | 1/2006 | Wang et al. | 24/389 |
| 2007/0237585 | A1 * | 10/2007 | Frantz | 405/107 |
| 2007/0243021 | A1 * | 10/2007 | Tyler | 405/115 |
| 2009/0053441 | A1 * | 2/2009 | Cain et al. | 428/36.1 |
| 2010/0129156 | A1 * | 5/2010 | Taylor | 405/114 |

* cited by examiner

*Primary Examiner* — Katherine Mitchell

*Assistant Examiner* — Marcus Menezes

(74) *Attorney, Agent, or Firm* — Andrew C. Aitken

(57) ABSTRACT

A flood barrier device that includes a fluid-tight flexible chamber with front panel, a rear panel, opposite lateral side-walls, top end walls, bottom end walls and an opening to allow the introduction of fluid into said chamber. The device includes a pair of support members that include a rigid spar connected to the chamber and having a bend at a medial position to orient a first section of the chamber in a first horizontal plane and a second section of said chamber into a second upright plane and a re-sealable waterproof seal device between the chamber and an adjacent fluid tight flexible chamber.

9 Claims, 10 Drawing Sheets

FLOOD PROTECTION BARRIER SYSTEM AND METHOD

The Applicant claims the benefit of the filing date of U.S. No. 61/795,733 filed on Oct. 24, 2012.

FIELD OF THE INVENTION

The present invention relates to a flood barrier system for the protection of structures using a number of bladders attached together.

BACKGROUND OF THE INVENTION

Damage to structures caused by flooding are well known and over the years various devices have been developed to try to mitigate the damage. Since it is reported that a significant amount of flood damage in the U.S. is caused by flood having height in less than 1 meter of water, effective devices can be provided that protect against flood levels of only a few feet.

While there are a number of devices designs that form barriers using cylinders, sleeves or oblong chambers filled with water or air and placed on the earth in the path of water stream or around regions that require protection, the use of sandbags remains a popular and conventional response. While the materials used for sandbagging efforts are relatively inexpensive and effective, the filling of bags is labor intensive and, after the flood has subsided the bags present a significant disposal problem with respect to labor and space.

There have been many efforts to provide improvements over the sandbagging solution for flood protection. Such devices include those made from watertight tube-like sleeves chambers, balloons, and other members made from a flexible material such as synthetic resin and composites.

U.S. Pat. No. 6,957,928 to Lofton offers a mobile system that uses augers for fastening to the ground and a rigid flange that is integrated to inflatable cylinders (tubular sleeves) by means of netting positioned over tubular sleeve that is anchored on opposite sides of tubular sleeve by said augers.

U.S. Pat. No. 4,981,392 to Taylor discloses a water filled structure used to construct temporary dikes. The device is directed to two identical elongated flattened cylinders which are sealed at opposite lateral ends to form a sealed, watertight chamber within a cylinder. The cylinders are joined by a flexible web. Several modules may be stacked in an interlocking structure of any desired height without the use of fastening elements. These blocks are the constructive "bricks" intended for forming a laterally interlocking structure and cannot form a continuous protective barrier.

In U.S. Pat. No. 5,645,373 Jenkins J. T. describes a temporary flood control system comprising elongated flexible, inflatable, tubular members secured to each other and adapted to be disposed on the ground for anchoring a generally sheet like vertically extendable barrier wall or an inflatable tubular barrier sleeve disposed above and connected to the ballast members. These members are at least partly fillable with ballast, and may be inflated with pressurized air.

U.S. Pat. No. 6,126,362 to Carter et al describes a dike system consisting of two different tube-like sleeves that are fastened to each other. A skirt-cloth extends from the front side of the barrier abutting against the floodwaters to prevent water leakage under the dike.

U.S. Pat. No. 5,125,767 (Dooleafe, D, 1992) discloses a barrier formed from a pair of water filled elongate flexible chambers and that may incorporate additional flexible water filled bag in the ends thereof as anchors. U.S. Pat. No. 6,783, 300 to Doolaege, discloses flexible sleeves including a zipper but the system lacks a rigid framing system.

U.S. Pat. No. 6,641,329 to Clement discloses a barrier formed by a plurality of tube-like elongate flexible sleeves connected by straps.

The publication of Harry, 20020110424 discloses an elongated liquid-tight container filled with a liquid and includes an eyelets that receive stakes to secure the system to the ground. The patent to Baruh, U.S. Pat. No. 6,164,870 discloses an inflatable dike structure for protecting houses and roadways.

While there have been many devices directed at flood water barriers, there remains a need for an inexpensive device that can be rapidly implemented during imminent flood conditions, assembled without skilled labor using conventional tools. The present invention is thereby directed at an alternative flood protective system for structures that is inexpensive, reusable, effective and relatively easy to assemble, disassemble and store.

SUMMARY OF THE INVENTION

The present invention is directed to a mobile and temporary barrier system for the protection against flood damages with respect to structures. As illustrated by the preferred embodiments disclosed herein, the barrier can be rapidly assembled and implemented with simple tools. The system of the invention includes a series of elongate water-tight flexible chambers that can be filled with water and positioned against the side of structure so that hydrostatic flood water pressure holds the device in sealing engagement with the ground and the structure.

The system includes "L shaped" frame members that assist in the positioning of chambers in an upright position. Adjacent devices are connected together using waterproof zippers provided on the lateral sides of the devices. The device also includes opposite lateral fabric flaps that are designed to engage opposite lateral flaps that protect the zipper and can received a waterproof gel material that also serves as a barrier. After use, the barriers can be removed, emptied, collapsed and folded so they can be easy transported and stored.

The system described herein provides a relatively simple, inexpensive, reusable, and effective manner to protect property from damage from floods.

BRIEF DESCRIPTION OF THE DRAWINGS

A detailed description of embodiments of the present invention will follow by reference to the following drawings. These drawings depict only typical embodiments of the invention and are therefore not to be considered limiting of its scope. In the drawings.

DETAILED DESCRIPTION

Figure 1:
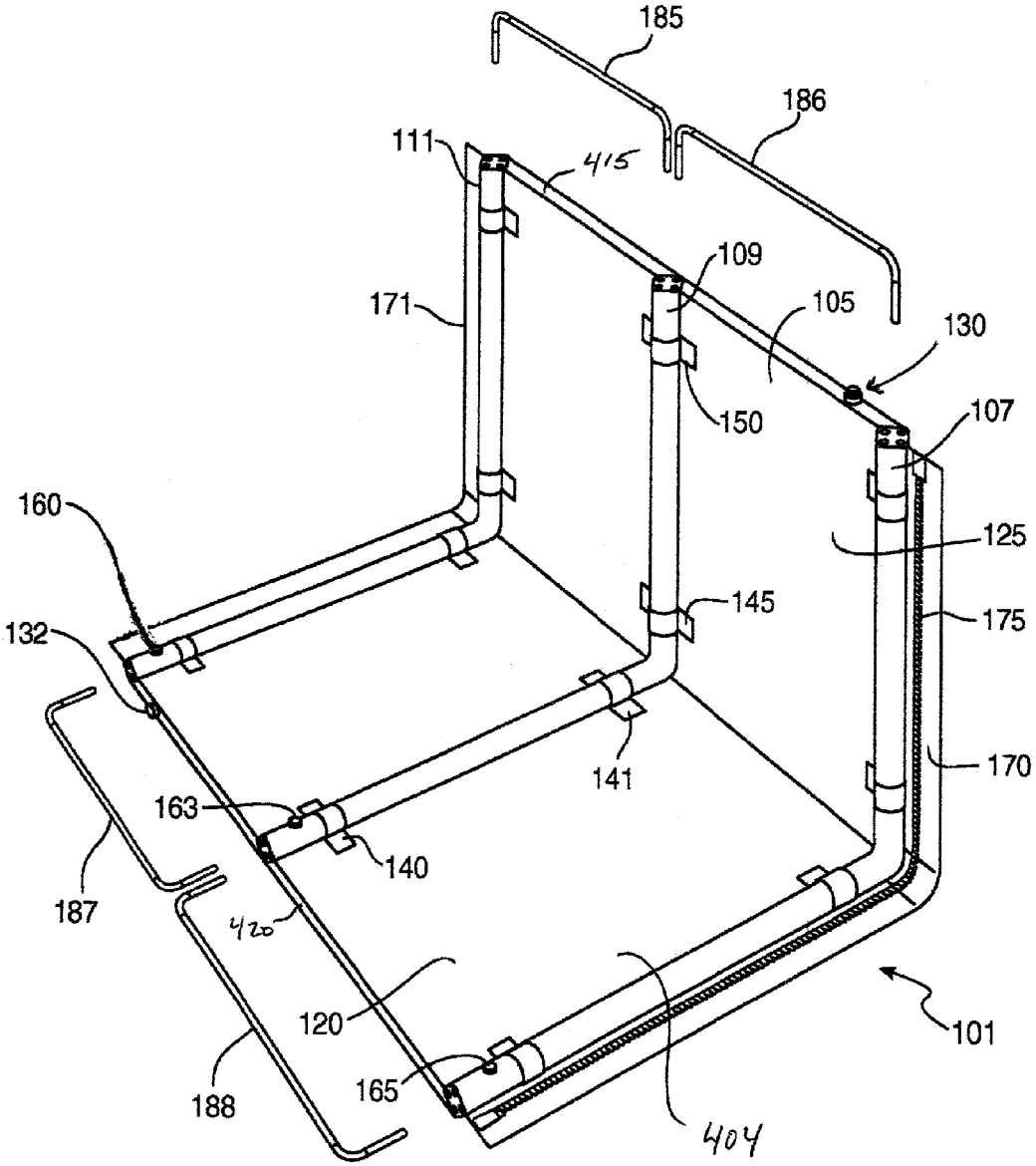
FIG. 1 is a front perspective partially exploded view of a first embodiment of the invention.
Figure 2:
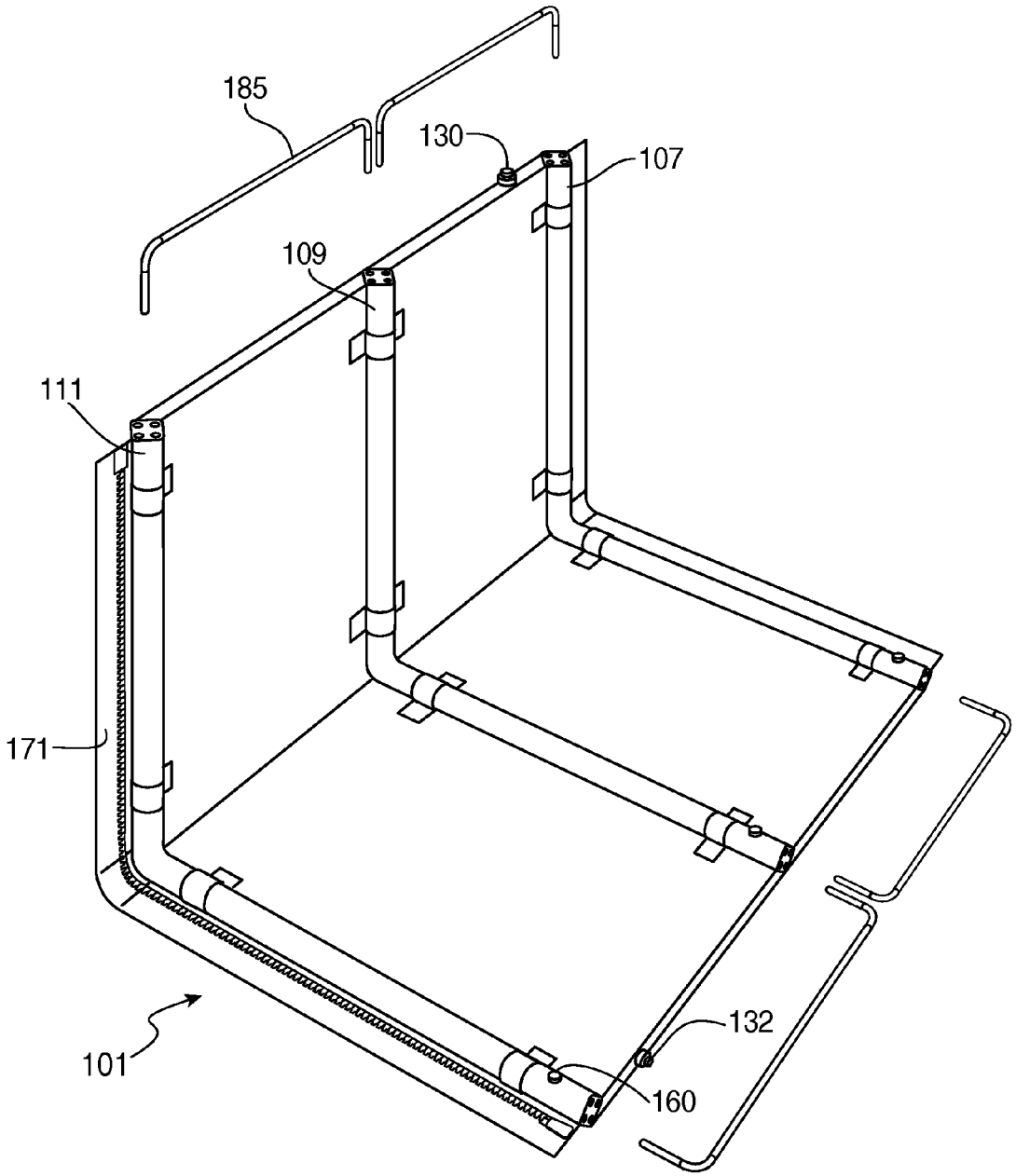
FIG. 2 is a side perspective partially exploded view of the embodiment depicted in FIG. 1.

Now referring to FIG. 1, a first embodiment 101 of the invention includes a watertight flexible chamber 105 having "L-shaped" lateral support members 107, 109 and 111. Support members 107, 109 and 111 are made from a relatively rigid material which, in a preferred embodiment, is PVC. Other suitable materials for the L shaped support members include other synthetic resins, fiberglass composites, metal, and wood. Flexible chamber 105 is attached to the members and the members thereby arrange the chamber into two planes, a bottom horizontal plane section 120 and an upright planar section 125.

Chamber 105 includes a first re-sealable opening 130 that is sized to receive a conventional garden hose. In preferred embodiments the opening includes threads that can engage opposite threads on conventional garden hose and the filling operation can take place without constant supervision by the user. When the chamber is filled a vent allows for the overflow of water to be released. In preferred embodiments the vent directs water overflowing from chamber 105 in the direction towards the lower planar section 120. The chamber has a second opening 132

Figure 4:
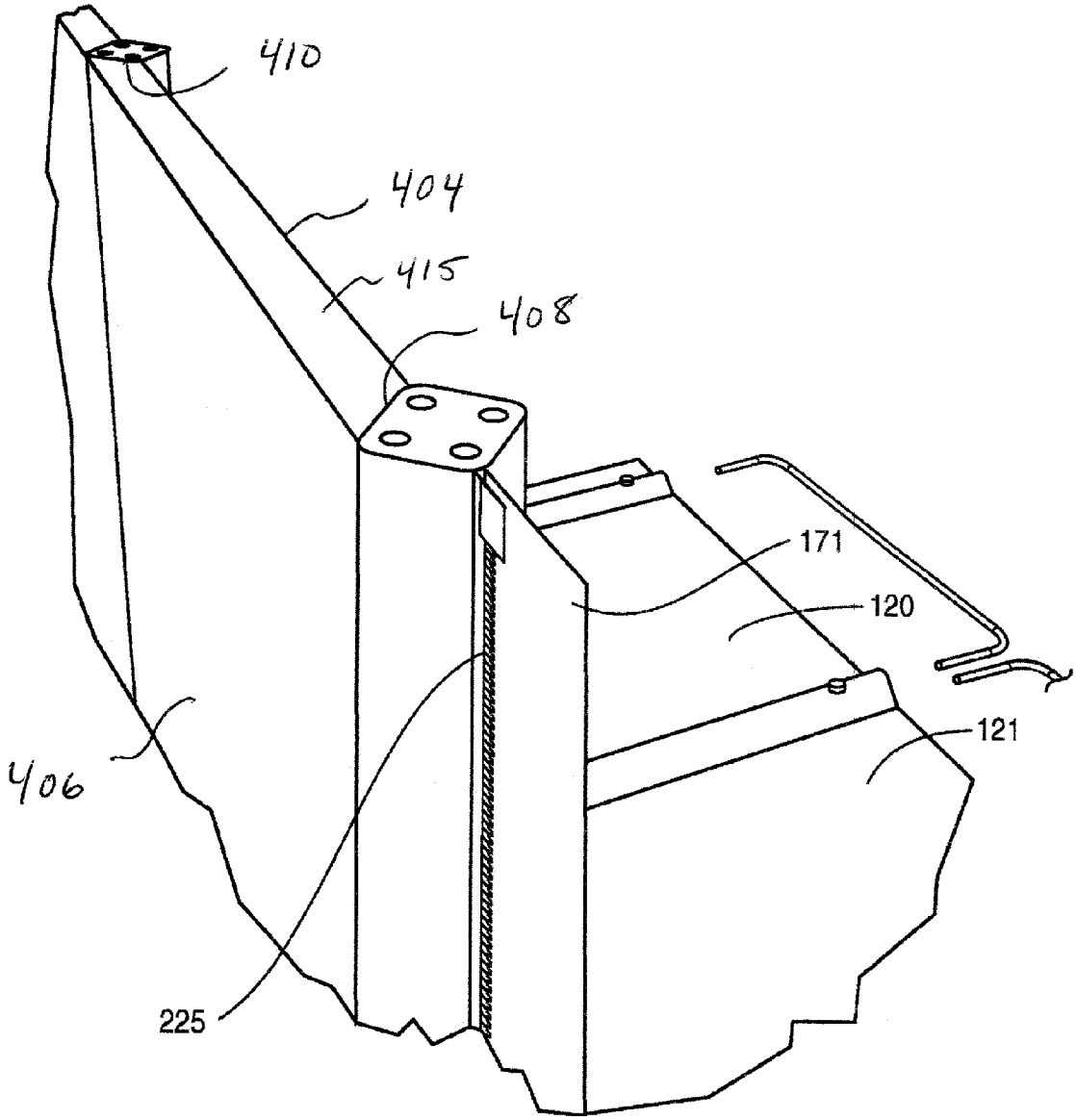
FIG. 4 is an enlarged rear perspective view of the upright section of the embodiment of the invention depicted in FIG. 1.

The "L-Shaped" members 107, 109 and 111 orient the upright planar section 125 of the chamber 105 at an angle of a slightly more than 90 degrees with respect to the lower section 120. Chamber 105 is mechanically attached to the "L Shaped" by flexile cloth loop extensions that extend from the chamber. As illustrated in FIG. 1, fasteners 140, 141, 145 and 150 attach member 109 to the chamber 105. In embodiments, a hook and loop fastener is used to attach the flexible cloth. In a contemplated alternative embodiment, tubular fabric sleeves are attached to the chamber and receive support members. As best seen in FIG. 4, chamber 105 includes a front panel 404 a rear panel 406, opposite lateral sidewalls 408 and 410 and a top end wall 415.

While the embodiment depicted in FIG. 1. depicts three members 107, 109 and 111 to provide support to the chamber, other configuration including providing only two support member for each chamber, providing 4 support members for each chamber and other combinations are contemplated. Also shown in FIG. 1 are lateral flaps 170 and 171. Provided on lateral flap 170 is a zipper 175 for engagement of adjacent devices. To attached adjacent devices, the flaps are oriented to access the zippers.

In preferred embodiment, the zipper is a waterproof and the parts, including the zipper and sides of the flaps that engage one another are coated with a silicone gel. Waterproof zippers are available from Szip Zipper, Shanghai Zipper Manufacturing Co. Ltd., Jiading District, Shanghai, China and can be located at www.tizip.com and wwwazipper.com. Waterproof zippers are also available from YKK Corporation, 1, Kanda Izumi-Cho Chiyoda-Ku Tokyo, Japan.

Figure 3:
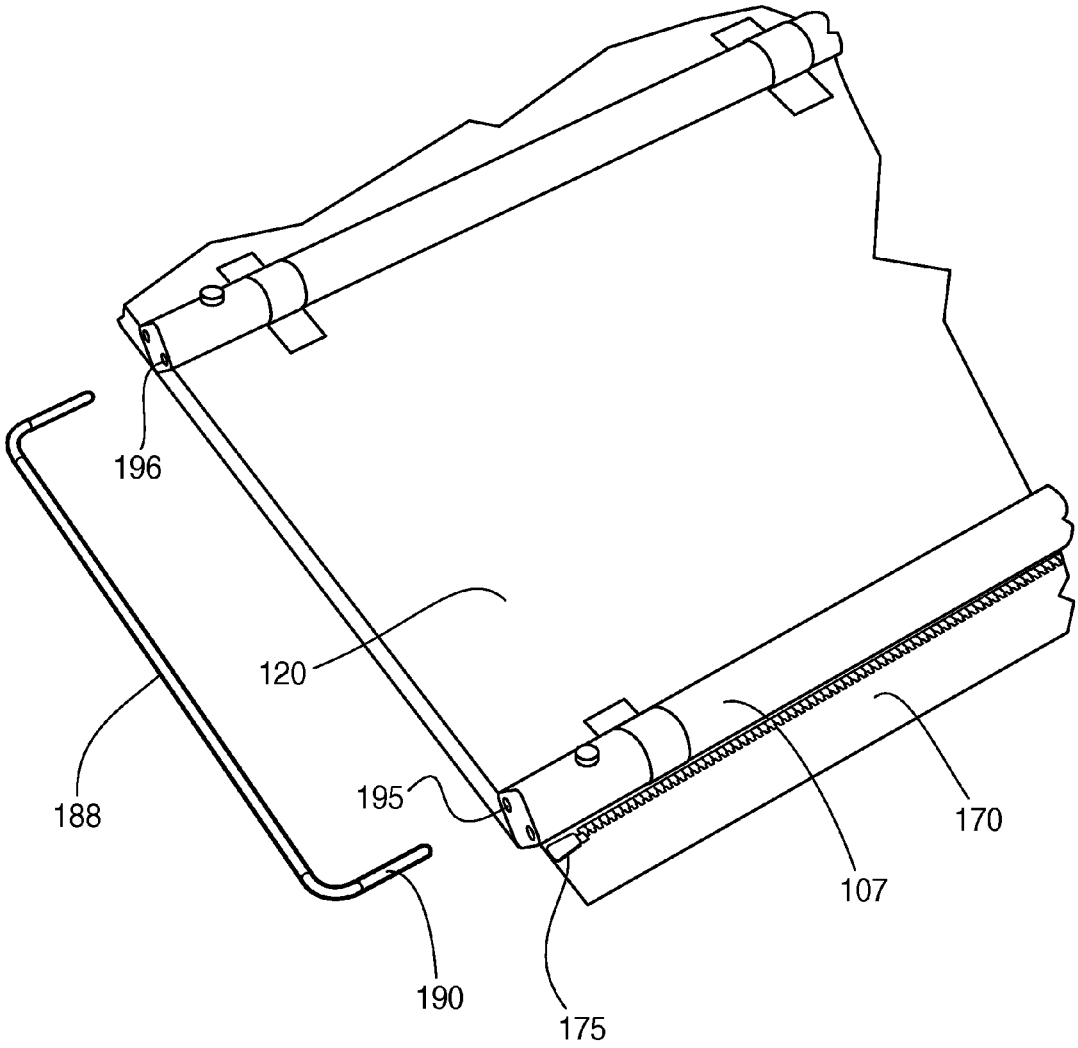
FIG. 3 is an enlarged front perspective view of the horizontal base section of the embodiment of the invention depicted in FIG. 1.

In order to maintain the chambers in a stable position during flood conditions, connector rods 185, 186, 187 and 188 engage the ends of the L Shaped support members. As best seen in FIG. 3, the connector rod are inserted into the ends of support members and maintained in place by a frictional engagement. For example, the diameter of opening 195 on the end of support member 107 is slightly larger than the diameter of the section 190 of connecting rod 188.

Additional connector rods can be used to attach adjacent members together and maintain the respective support members a predetermined and fixed distance apart from one another. The embodiment of FIGS. 1-4 also includes surface mounting pin 160, 163 and 165. Pins 160 163 and 165 can receive additional rigid rod members (not shown) to maintain the distance between adjacent rod member and tie adjacent devices together. In the embodiment depicted in FIGS. 1-4 the connecting rods are solid steel rods that are bent on opposite ends in a direction perpendicular to the axis. The ends engage apertures provided on the ends of the "L Shaped" support members. Also depicted in FIG. 1 is water drainage opening 132 provided on end wall 420 of lower chamber region 120. A front panel 404 spans lower chamber region 120 and upper planar region 125.

It is apparent that the embodiment depicted in FIG. 1 uses three support members to maintain the chamber in the desired position. Now referring to FIG. 5, an alternative embodiment of a barrier device 505 is depicted that includes flexible watertight chamber 510 that includes horizontal section 514 and upright section 515. Like the embodiment described above, the device includes lateral flaps 520 and 521 that extend from the lateral sidewalls of the chamber and which are that include zipper parts, such as 527, for attachment to adjacent panels. Upright section 515 is maintained in position by spar members 530 and 531. Spar member 530 is pivotally attached to connection device 535 to allow the member to move with respect to member 540. In embodiment the attachment of upright spar member may be a locking hinge device that restricts movement, or a pin that allows for rotation. Stop members may be provide don member 535 to restrict the motion of the spars with respect to the member 535. For example, a spring biased stop members (not shown) may be pushed in to allow a top spar member to pivot to a folded position. In other embodiments, the spar may be positioned in a first position wherein a spring biased member is provided on the spar and can pass through an aperture position on the connection member and lock the spar in place. To unlock the spar, pressure is exerted on the stop member until it passes though the top surface of the connection member thereby allowing the member to pivot in the member on a pivot pin. These spring biased stop members are commonly provided on portable canopies. Like the embodiment of FIG. 1, the device includes rigid connecting members 561 and 562 to maintain a fixed distance between adjacent support members. Support member spar 530 is attached to the upper section 514 of the chamber 510 by fabric straps 570, 571. The lower spar 540 is attached to base section 514 of chamber 510 by straps 572 and 573.

Figure 5:
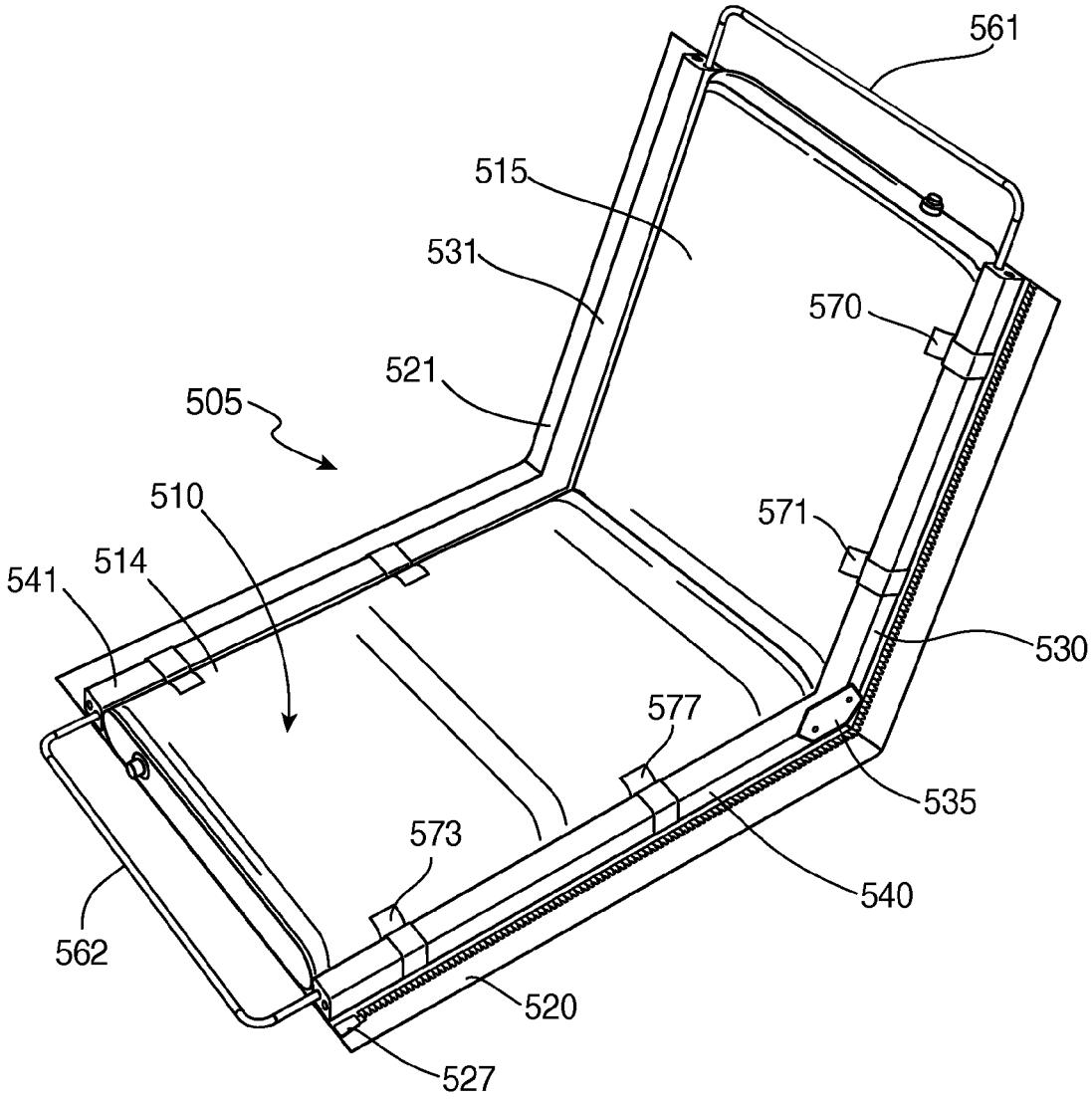
FIG. 5 is a front perspective view of a second embodiment of the invention.
Figure 6:
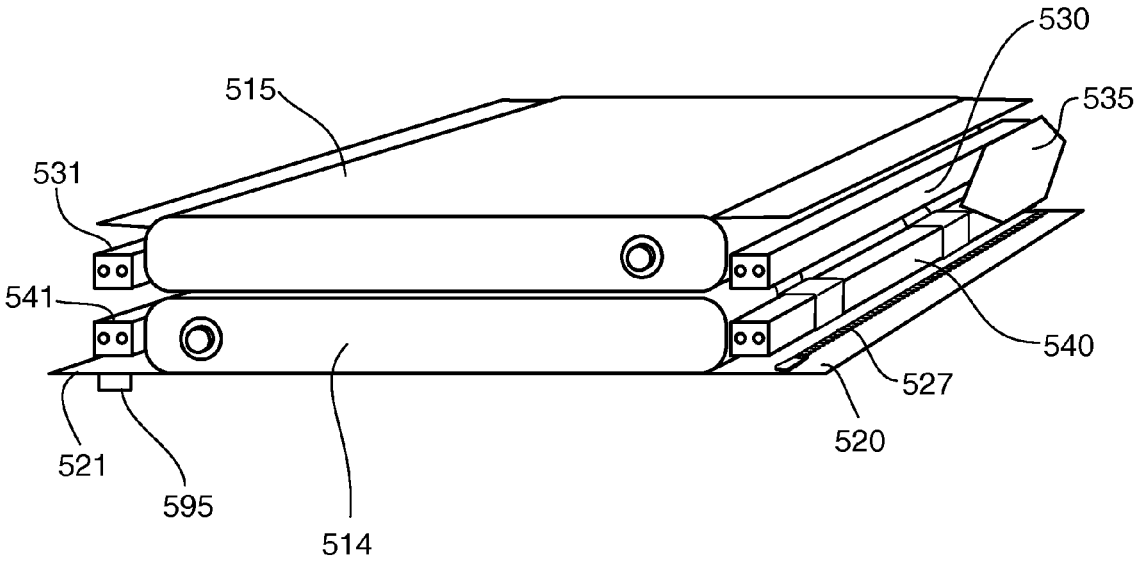
FIG. 6 is a front perspective view of the embodiment of the invention depicted in FIG. 5 that has been folded.

Now referring to FIG. 6, the embodiment depicted in FIG. 5 is depicted in a folded position. As such the ability of the support member to pivot about connector 535 allows the this embodiment to be folded and easily stored, wherein spar 530 is position adjacent and in line with spar member 540 and member 531 is positioned adjacent to member 541. FIG. 6 also depicts the zipper structure 595 on the bottom of flap 521 that extends from the lateral side of chamber.

Figure 7:
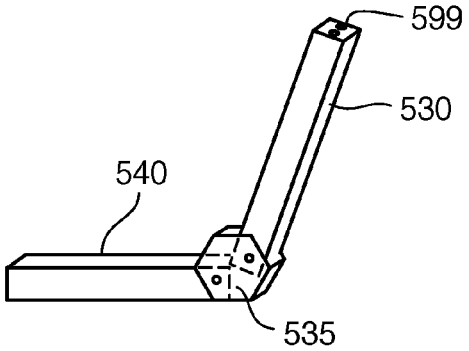
FIG. 7 depicts a perspective view of a support member according to the second embodiment.
Figure 8:
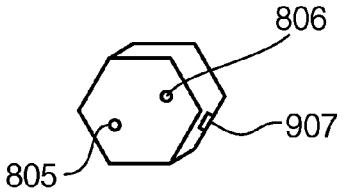
FIG. 8 depicts a perspective view of a medial connection device that allows the spars to pivot with respect to one another. at FIG. 9 is front elevation view of the medial connection device depicted in FIG. 8.
Figure 9:
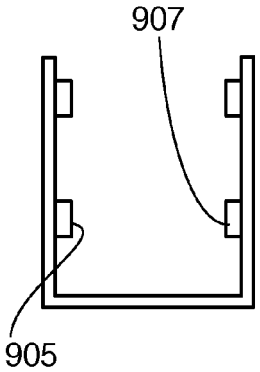
Figure 10:
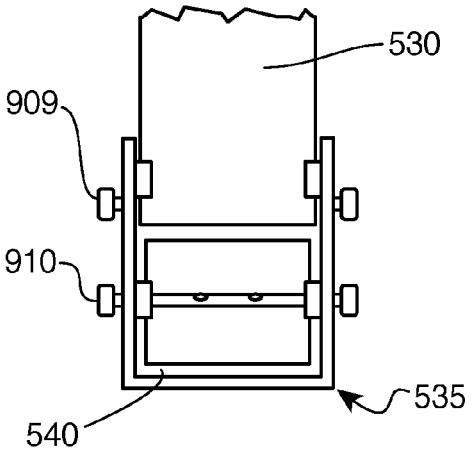
FIG. 10 is a fractional rear elevation view of the support member device depicted in FIG. 7.

FIG. 7 depicts the support member that includes the connector part 535, base support member 540 and upright spar support member 530. The ends of the spar member include apertures 599 to receive connecting rods. As best seen in FIG. 8 connecting member includes apertures 805 and 806 to receive pins on which the support spar members can pivot. As best seen in FIG. 9, the connector member includes stop member 907 and 908 that restricts free movement of the spars. FIG. 10 depicts spar member 540 and 530 attached to connecting member 535. The members are attached to the connector 535 using pins 910 and 909 that permit pivotal motion.

Figure 11:
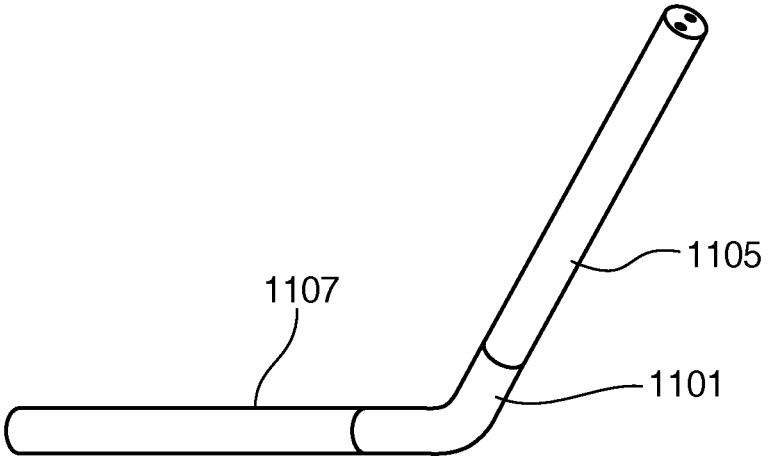
FIG. 11 is perspective vied of an alternative support member device.
Figure 12:
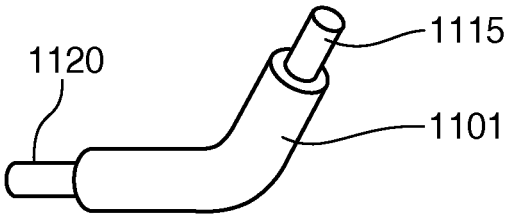
FIG. 12 is a perspective view of a connector used in connection with the support member device depicted in FIG. 11.

FIG. 11 depicts an alternative embodiment of a support member wherein the upright section 1105 is a fixed position with respect to the lower section 1107. Section 1105 is attached with connection device 1101. As seen in FIG. 12 the connection device 1101 includes extensions 115 and 1120 that are received in the ends of the tubular support members.

Figure 13:
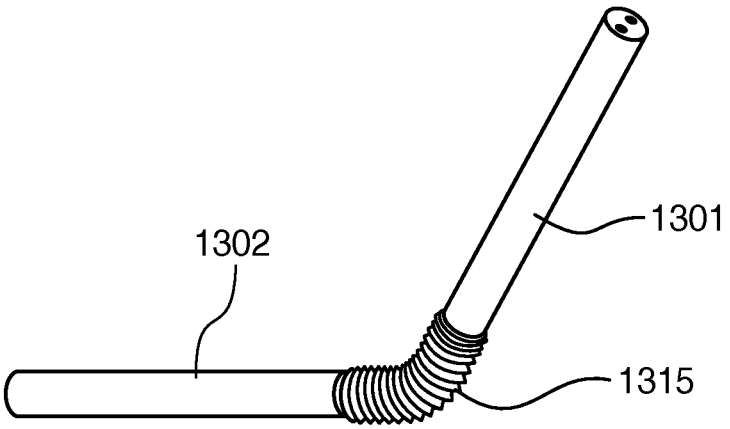
FIG. 13 is yet a further support member device that can be used in connection with embodiments of the invention.

FIG. 13 depicts yet another embodiment of a support member wherein the upright support member 1301 is attached to the lower member 1302 with a flexible bellows connector 1315 that allows the members to be positioned to one another at variable angles.

Figure 14:
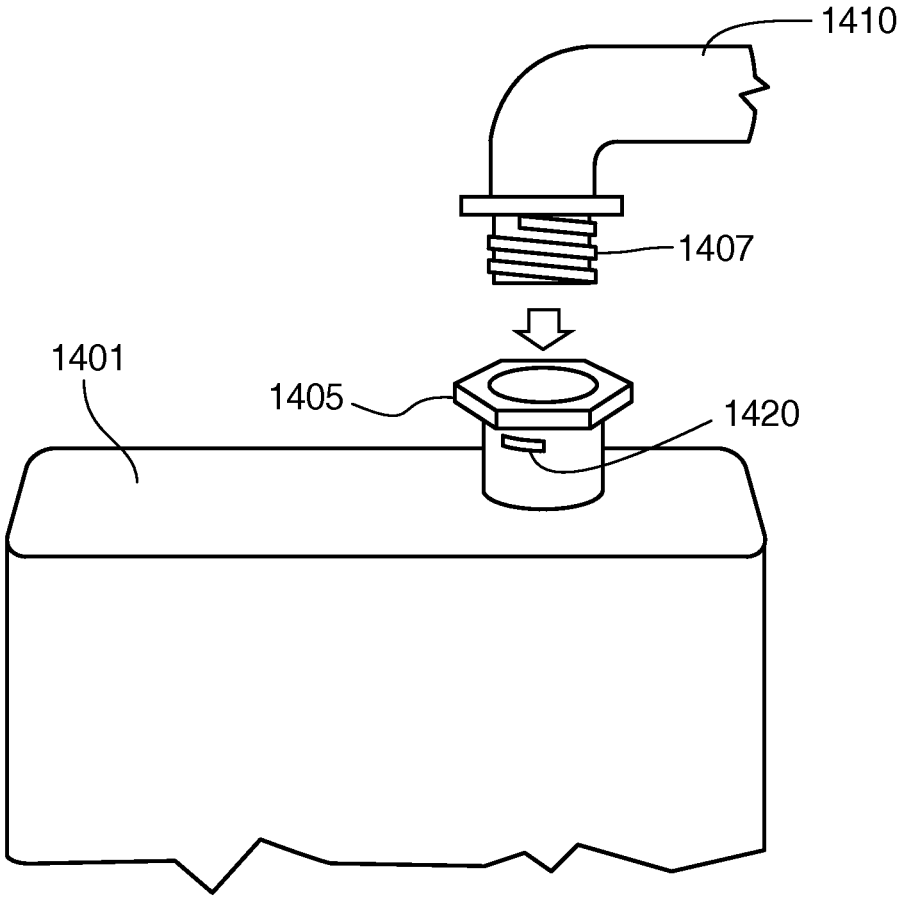
FIG. 14 is a fractional view of the upper section of a chamber in connection with a hose that shows the vent provided in an upper port used to fill the device.
Figure 15:
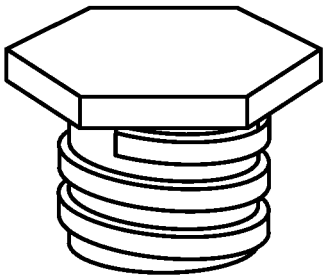
FIG. 15 is a view of a plug in perspective that is received in the port and makes a watertight seal.

As discussed above and now referring to FIG. 14, in an embodiment of the invention, a port 1405 is adapted to receive the end 107 of a conventional garden hose 1410. A vent 1420 allows air to escape from chamber 1401 during the filling operation and when the chamber has been filled will vent excess water. FIG. 15 depicts a plug that can be inserted into port which seals the opening including the vent.

Figure 16:
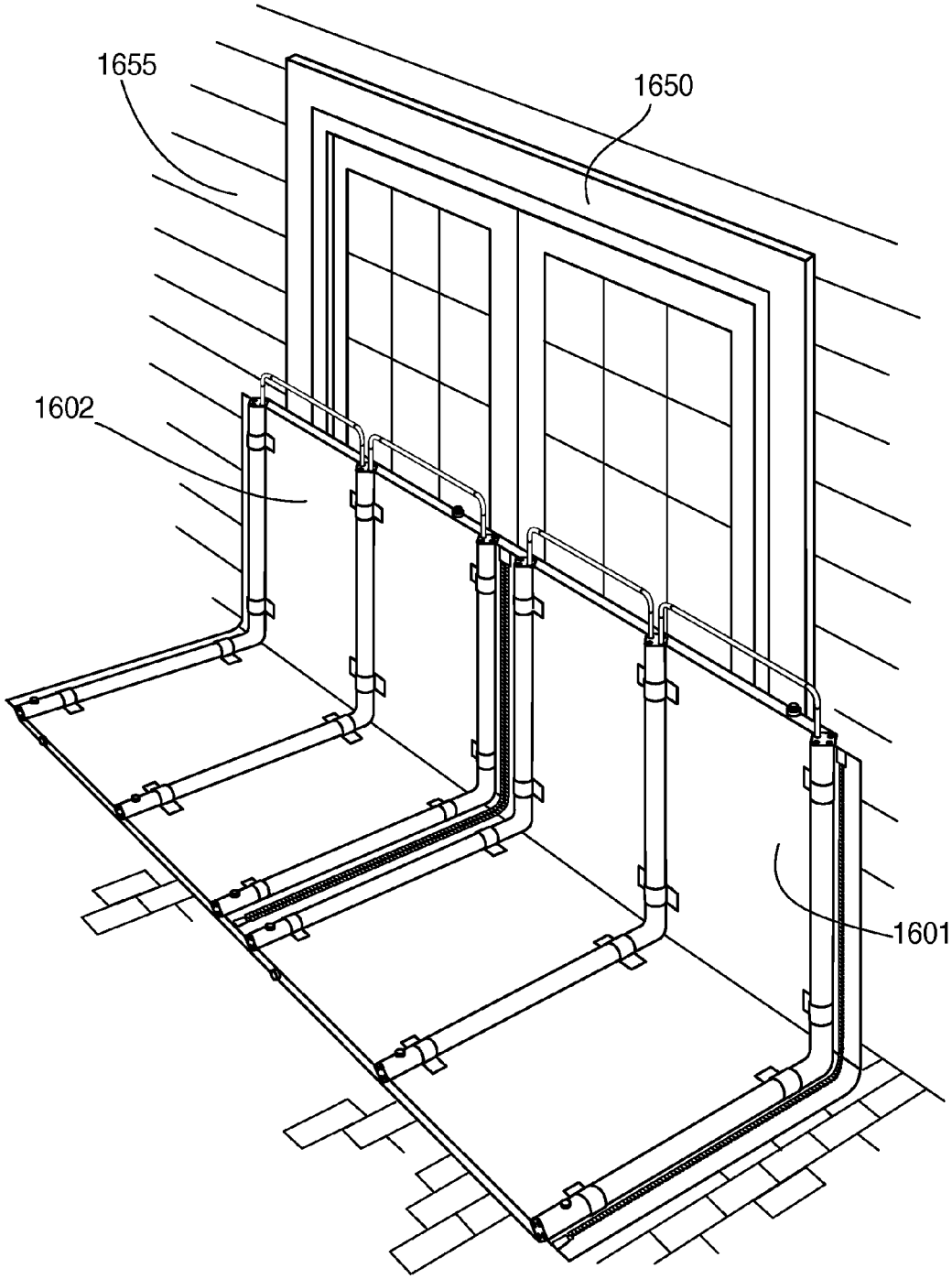
FIG. 16. is system wherein two devices are attached to one another at the lateral sides and then positioned against a door of a structure

Now referred to FIG. 16, an exemplary system is depicted wherein a plurality of devices 1601 and 1602 are attached to one another at the lateral sides and then positioned against a door 1650 of a structure 1655 to protect the structure from flood damage. The devices can be secured in place by mechanically affixing the devices to the structures that are intended to be protected. For example, the user can nail or staple through the flap region adjacent to the upright portion of the chamber to secure the device. In addition, the support members can be provided with weights to help secure the devices in place. For example, a hollow support member may can be filed with rebar or, alternatively, the support member can be made of steel.

It will be clear to one skilled in the art that the embodiments described above can be altered in many ways without departing from the scope of the invention. Accordingly, the scope of the invention should be determined by the following claims and their legal equivalents.

I claim:

1. A flood barrier device comprising:

a fluid-tight flexible chamber having a first re-sealable opening to allow an introduction of fluid into said chamber;

said chamber having a lower section with a lower section bottom panel part, a lower section top panel part, lower section lateral side walls, and a lower section end wall, and wherein said lower section top panel part and said lower section bottom panel part are substantially parallel with each other;

said chamber further comprises an upper section, said upper section contiguous with said lower section and wherein said upper section includes an upper section bottom panel part, an upper section top panel part, upper section lateral side walls, and an upper section end wall, and wherein said upper section bottom panel part and said upper section top panel part are substantially parallel with each other;

said chamber is bent at a medial location to establish said lower and upper sections; and a pair of support members, said support members connected to said chamber and adjacent to said lower section lateral side walls and said upper section lateral side walls and having a bend at the medial location to orient said lower section of said chamber in a first horizontal plane and said upper section of said chamber into a second upright plane.

2. The flood barrier device recited in claim 1 further comprising connectors, said connectors attached to said support members and extending in a perpendicular direction from said support members wherein said connectors maintain a fixed distance between support members.

3. The flood barrier device recited in claim 2 wherein said connectors are attached to ends of said support members.

4. The flood barrier device recited in claim 1 further comprising a second re-sealable opening, wherein said first opening is located in said upper section of said chamber and said second re-sealable opening is located on said lower section end wall.

5. The flood barrier device recited in claim 1 wherein each of said support members further comprises a first elongate member and a second elongate member and a hinge, wherein said first elongate member can be folded toward said second elongate member.

6. The flood barrier device as recited in claim 1 further comprises a water proof seal device further comprising a zipper.

7. The flood barrier device as recited in claim 6 wherein said water proof seal device further comprises waterproof fabric flaps that extend from lateral sides.

8. The flood barrier device as recited in claim 6 wherein said water proof seal device further comprises silicone gel.

9. The flood barrier device recited in claim 1 further comprising a second re-sealable opening and wherein said first re-sealable opening further comprises means to be removably attached to a garden hose and further comprises a vent to allow air and fluid to pass out of said first re-sealable opening when said first re-sealable opening is attached to said garden hose.

* * * * *